US005527433A

United States Patent [19]

Begemann et al.

[11] Patent Number: 5,527,433

[45] Date of Patent: Jun. 18, 1996

[54] DEVICE AND METHOD FOR CHOKING A STOCK SUSPENSION FLOW IN A PAPER MACHINE

[75] Inventors: Ulrich Begemann, Leonberg; Helmut Heinzmann, Bohmenkirch, both of Germany

[73] Assignee: J.M. Voith GmbH, Heidenheim, Germany

[21] Appl. No.: 396,120

[22] Filed: Feb. 28, 1995

Related U.S. Application Data

[62] Division of Ser. No. 268,288, Jun. 30, 1994.

[30] Foreign Application Priority Data

Jul. 5, 1993 [DE] Germany ..... 43 22 323.0
Jan. 28, 1994 [DE] Germany ..... 44 02 515.7

[51] Int. Cl.[6] ..... D21F 1/00; F15D 1/00

[52] U.S. Cl. ..... 162/216; 162/212; 138/43

[58] Field of Search ..... 138/40, 42, 43, 138/44, 45, 46; 251/118, 121, 122, 126; 162/380, 336, 289, 202, 212, 216

[56] References Cited

U.S. PATENT DOCUMENTS 3,095,006 6/1963 Smith ..... 137/269.5
5,156,750 10/1992 Henricson et al. ..... 210/783

*Primary Examiner*—Donald E. Czaja
*Assistant Examiner*—Calvin Padgett
*Attorney, Agent, or Firm*—Baker & Daniels

[57] ABSTRACT

A throttle device for stock suspensions in a paper machine including a feed line, a drain line and a spatially variable cavity connecting the feed line and drain line with each other. The cavities provided with a plurality of nestable walls in which the nesting effects a lengthening of the flow path.

5 Claims, 1 Drawing Sheet

DEVICE AND METHOD FOR CHOKING A STOCK SUSPENSION FLOW IN A PAPER MACHINE

This is a division of application Ser. No. 08/268,288, filed Jun. 30, 1994.

BACKGROUND OF THE INVENTION

The invention concerns a device and a method for choking a stock suspension flow in a paper machine or system for stock treatment.

For choking fluid flows, valves of various designs are prior art. A considerable disadvantage of these standard valves, such as ball valves, needle valves, flap valves, slide valves and similar, is that for generating the desired flow resistance they must create very narrow cross sections, which normally tend to clogging when the fluid passing through them carries fibers.

Reference is made to the unpublished German patent application P 42 39 643. It presents a throttle device which for choking a fluid flow essentially utilizes turbulence phenomena which occur or are generated therefor and, thus, can dispense with narrow cross sections. An unfavorable characteristic of this device is its limited working range.

The problem underlying the invention is to describe a throttle device which is suited specifically for use in paper machines and, for one, is with regard to the clogging tendency less susceptible than the standard valves and, for another, has a working range greater than the throttle device presented in the aforementioned patent application. An example of a paper making machine in which the throttle device of the present invention can be used is disclosed in U.S. Pat. No. 4,050,479, which patent is expressly incorporated herein by reference.

SUMMARY OF THE INVENTION

This problem is solved by providing a throttle device for stock suspensions wherein the length of the flow path within the throttle device is varied continuously or discretely (i.e., by a finite number of distinct incremental adjustments). For example, the cavity in the throttle device can be provided with a plurality of nestable walls in which the nesting causes a lengthening of the flow path.

It is recognized that the avenue chosen in standard fashion for generating a variable resistance in a throttle device consists in altering a cross section, with the peak losses generated there determining the level of resistance. This gives rise to the possible generation of undefined eddies and, thus, cloggings respectively, when using such throttle devices for stock suspensions in a paper machine, of so-called fiber tuft formations capable of impairing the paper quality.

A possible other way to generate resistance, notably when the width of the generated resistance remains within limits, is altering the flow path. This can be accomplished, e.g., by lengthening the flow path, for instance in that the stock suspension is passed along a zig-zag course within the throttle device with variable amplitude, or in that a rotational component is added to a flow pattern which in basic state is approximately rectilinear, so that the more or less pronounced rotation entails a correspondingly longer path for the flow to pass. Another way of choking a flow is constituted by withdrawing energy from the flow due to variably heavy eddy formation or in that successively arranged accelerating and retarding stretches are installed in the throttle device. Of course, there is also the option of combining the effects described above with one another, whereby, for example, cleaning effects of favorable action can be utilized as well.

BRIEF DESCRIPTION OF THE DRAWINGS

The invention will be more fully described with the aid of the figures, which show the following.

DETAILED DESCRIPTION

Figure 1:
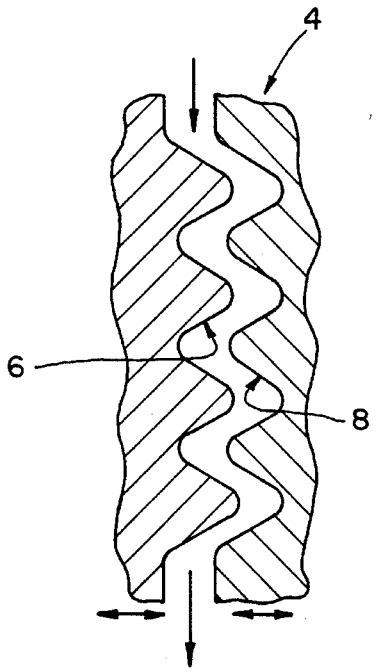
FIGS. 1 through 3 are cross sectional views of three variants of a throttle device according to the present invention.

FIG. 1 shows schematically a throttle device 4 in which two wavy surfaces 6 and 8 can be moved toward respectively away from each other. That is, with a diminishing spacing of the surfaces 6 and 8, a path that becomes ever longer is imposed on the fluid passing between the two surfaces, which is accompanied by an increase in resistance. Importantly, the resistance generated here does not result from peak effects through extreme constrictions, but merely from a lengthened path of the fluid. The invention also provides the option of moving the two opposed surfaces 6 and 8 in relative longitudinal directions so that, as the spaces are passed by the fluid, accelerating and retarding effects occur additionally, since the flow is required to traverse areas of alternating larger and smaller cross sections.

Figure 2:
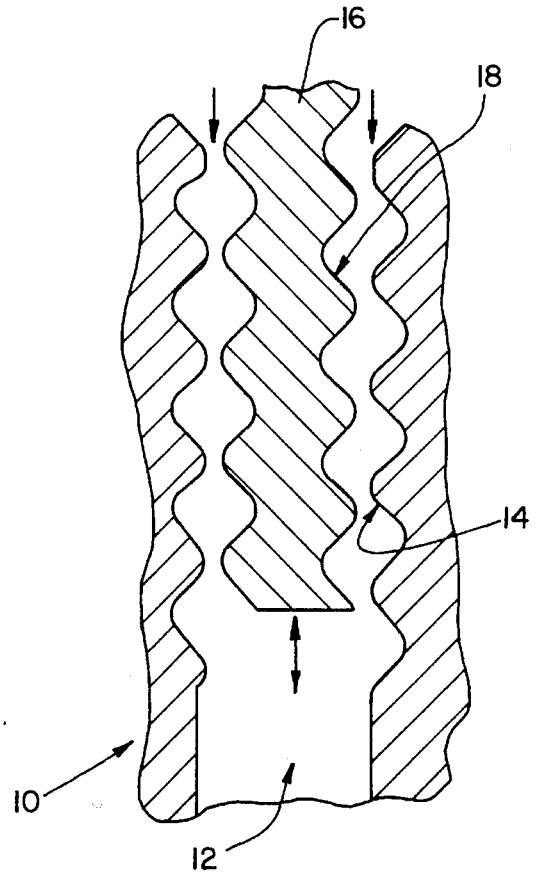

FIG. 2 shows another inventional throttle device 10. Here, the fluid is made to pass through an approximately cylindrical cavity 12 whose interior wall 14 undulates spirally. A piston 16 which as well is undulated, preferably spirally and evenly, on its outside surface 18 is axially inserted into said cavity. With the piston 16 retracted completely from the narrower section, the fluid can flow through the throttle device nearly unimpededly, taking the direct, rectilinear path. Pushing the piston 16 into the constriction 12 forces the fluid to assume a spiral flow pattern due to the interaction of opposed surfaces 14 and 18, requiring the flow to travel an ever lengthening path as the piston 16 is pushed in increasingly and, consequently, causing also the resistance to the flow to rise. Important is here as well that the resistance is not generated due to extreme constrictions, but merely through the longer path traveled, which naturally engenders also elevated resistance.

Figure 3:
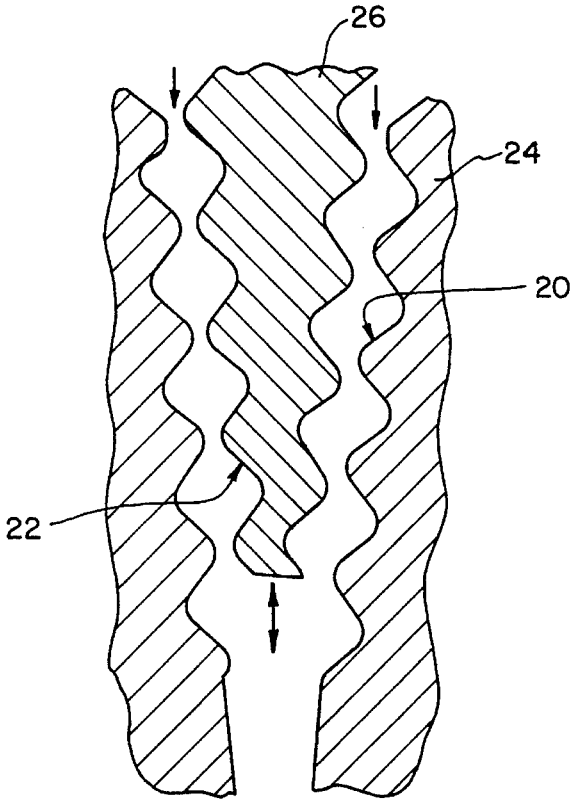

FIG. 3 shows an embodiment of a throttle device similar to FIG. 2, but the opposed surfaces 20 and 22 of cylinder 24 and piston 26, respectively, are conic in their basic shape.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for variably choking a stock suspension in a paper machine comprising flowing the stock suspension through a throttle device, the throttle device having a plurality of opposed surfaces, the opposed surfaces defining a flow path and having a spacing whereby the opposed surfaces are not in contact with each other and the throttle is in an open or partially open arrangement, and adjusting the length of the flow path of the suspension within the throttle device by axially moving the opposed surfaces relative to each other whereby the spacing between the opposed surfaces is adjusted.

2. The method of claim 1 wherein the flow path is varied continuously.

3. The method of claim 1 wherein the flow path is varied discretely.

4. The method of claim 1 wherein the stock suspension is caused to flow rotationally through the throttle device, and by moving the opposed surfaces relative to each other causes a variable angle of inclination to the flow path to occur.

5. The method of claim 1 wherein the opposed surfaces are wave-shaped.

* * * * *